US009649864B2

(12) United States Patent
Seo et al.

(10) Patent No.: US 9,649,864 B2
(45) Date of Patent: May 16, 2017

(54) INKJET MARKING DEVICE AND METHOD

(71) Applicant: QUALICAPS CO., LTD., Yamatokoriyama-shi, Nara (JP)

(72) Inventors: Masahiro Seo, Yamatokoriyama (JP); Hiroshi Sakuramoto, Yamatokoriyama (JP); Yoshihisa Konishi, Yamatokoriyama (JP); Tetsuhisa Ishida, Yamatokoriyama (JP); Motohiro Yagyu, Yamatokoriyama (JP)

(73) Assignee: QUALICAPS CO., LTD., Yamatokoriyama-shi, Nara (JP)

( * ) Notice: Subject to any disclaimer, the term of this patent is extended or adjusted under 35 U.S.C. 154(b) by 0 days.

(21) Appl. No.: 15/125,408

(22) PCT Filed: Mar. 2, 2015

(86) PCT No.: PCT/JP2015/056030
§ 371 (c)(1),
(2) Date: Sep. 12, 2016

(87) PCT Pub. No.: WO2015/146493
PCT Pub. Date: Oct. 1, 2015

(65) Prior Publication Data

US 2017/0096020 A1 Apr. 6, 2017

(30) Foreign Application Priority Data

Mar. 27, 2014 (JP) ..... 2014-064916

(51) Int. Cl.
*B41J 2/15* (2006.01)
*B41J 13/00* (2006.01)
*B41J 2/01* (2006.01)

(52) U.S. Cl.
CPC ..... *B41J 13/0009* (2013.01); *B41J 2/01* (2013.01)

(58) Field of Classification Search
CPC ..... B41J 13/0009; B41J 11/46; B41J 11/007; B41J 11/42; B41J 2/01; B41J 11/0005;
(Continued)

(56) References Cited

U.S. PATENT DOCUMENTS 9,056,457 B2 * 6/2015 Hasegawa ..... B41J 2/04505
9,254,647 B2 * 2/2016 Hasegawa ..... B41J 2/165

FOREIGN PATENT DOCUMENTS

JP 2011-20325 A 2/2011

OTHER PUBLICATIONS

English Translation of International Search Report of PCT/JP2015-056030.

* cited by examiner

*Primary Examiner* — Lamson Nguyen
(74) *Attorney, Agent, or Firm* — Muncy, Geissler, Olds & Lowe, P.C.

(57) ABSTRACT

An inkjet marking apparatus 1, wherein a printing means 220 comprises a printhead 222 provided with a plurality of nozzles 224 in a direction intersecting the conveying direction of printing substrates P, the printhead 222 is supported so as to be movable in a direction in which the nozzles 224 are arranged, and a control means, at a time of nozzle change when the nozzles 224 to be used are changed, suspends the operation of a feeding means 10 to form a non-holding area on a carrier means 20 where the printing substrates P are not held in a holding part 22 and, after the printing substrates P are printed, moves the printhead 222 during a time when the non-holding area passes through a printing area A.

6 Claims, 8 Drawing Sheets

(58) Field of Classification Search
CPC ..... B41J 11/003; B41J 11/0045; B41J 11/04;
B41J 13/02; B41J 13/03
See application file for complete search history.

(a)

(b)

INKJET MARKING DEVICE AND METHOD

TECHNICAL FIELD

The present invention relates to an inkjet marking apparatus and a method and, more specifically, an inkjet marking apparatus and a method suitable for forming a marking pattern on printing substrates such as pharmaceutical products and food products.

BACKGROUND ART

The configuration disclosed in Patent Literature 1 is a known example of an apparatus for forming a marking pattern on printing substrates such as tablets by inkjet printing. This printing apparatus creates a printing pattern for workpieces based on workpiece information such as the position and the orientation of workpieces detected by capturing images of workpieces randomly supplied by a feeding conveyor, and performs printing on the workpieces by an inkjet printer based on the printing pattern.

CITATION LIST

Patent Literature

Patent Literature 1: JP 2011-20325A

SUMMARY OF INVENTION

Technical Problem

A known configuration of inkjet printers has a line-type printhead that is provided with a larger number of nozzles placed in a direction perpendicular to the conveying direction of printing substrates, and printing can be performed by suitably selecting the nozzles to be used according to the printing positions of the printing substrates. While line-type inkjet printers are suitable for high-speed printing because it is not necessary to move the printhead during printing, nozzles that are seldom used may be clogged when there is a varied frequency between nozzles being used.

With the above-described conventional printing apparatus, the positions of the inkjet printer to which workpieces are transferred and the intervals of transfer are random and not uniform, it is therefore difficult to uniformly use all nozzles, and the above-described conventional printing apparatus is problematic in that nozzles that are less frequently used are likely to have discharge failures.

Accordingly, an object of the present invention is to provide an inkjet marking apparatus and a method that are capable of reliably printing a large number of printing substrates at high speed while preventing inkjet nozzles from becoming clogged.

Solution to Problem

The foregoing object of the present invention is achieved by an inkjet marking apparatus comprising:

a carrier means having a plurality of holding parts for holding printing substrates, the holding parts being provided at intervals in a conveying direction;

a feeding means for supplying the printing substrates to the holding parts;

a printing means for forming a marking pattern by inkjet printing on the printing substrates conveyed to a printing area by the carrier means; and a control means for controlling operations of the carrier means, the feeding means, and the printing means, wherein the printing means comprises a printhead provided with a plurality of nozzles in a direction intersecting the conveying direction of the printing substrates, and the printhead is supported so as to be movable in the direction in which the nozzles are arranged, and the control means, at a time of nozzle change when the nozzles to be used are changed, suspends the operation of the feeding means to form a non-holding area on the carrier means where the printing substrates are not held in the holding parts and, after the printing substrates are printed, moves the printhead during a time when the non-holding area passes through the printing area.

It is preferable that in this inkjet marking apparatus, the carrier means has rows of the holding parts such that a plurality of printing substrates conveyed to the printing area are placed in a direction in which the nozzles are arranged, and the rows of the holding parts are provided at intervals in the conveying direction.

It is preferable that the carrier means is formed in a drum shape having the holding parts in an outer circumferential surface.

It is preferable that the feeding means comprises a feeding drum having a plurality of holding parts in an outer circumferential surface and that the holding parts are provided at intervals corresponding to the holding parts of the carrier means, and it is preferable that the control means suspends rotation of the feeding drum to form the non-holding area on the carrier means.

It is preferable that the inkjet marking apparatus further comprises a detecting means for detecting the non-holding area before the holding parts pass through the printing area, and it is preferable that the control means moves the printhead based on detection of the non-holding area by the detecting means.

Moreover, the foregoing object of the present invention is achieved by an inkjet marking method comprising:

a feeding step of supplying printing substrates to a plurality of holding parts of a carrier means, the holding parts being for holding the printing substrates and being provided at intervals in a conveying direction;

a conveying step of conveying the printing substrates held in the holding parts to a printing area of a printing means by an operation of the carrier means; and a printing step of forming a marking pattern on the printing substrates conveyed to the printing area by inkjet printing, wherein the printing means comprises a printhead provided with a plurality of nozzles in a direction intersecting the conveying direction of the printing substrates, and the printhead is supported so as to be movable in the direction in which the nozzles are arranged, in the feeding step, at a time of nozzle change when the nozzles used in the printing step are changed, a supply of the printing substrates to the holding parts is suspended to form a non-holding area on the carrier means where the printing substrates are not held in the holding parts, and in the printing step, after the printing substrates are printed, the printhead is moved during a time when the non-holding area passes through the printing area.

Advantageous Effects of Invention

The present invention can provide an inkjet marking apparatus and a method that are capable of reliably printing a large number of printing substrates at high speed while preventing inkjet nozzles from becoming clogged.

DESCRIPTION OF EMBODIMENTS

Figure 1:
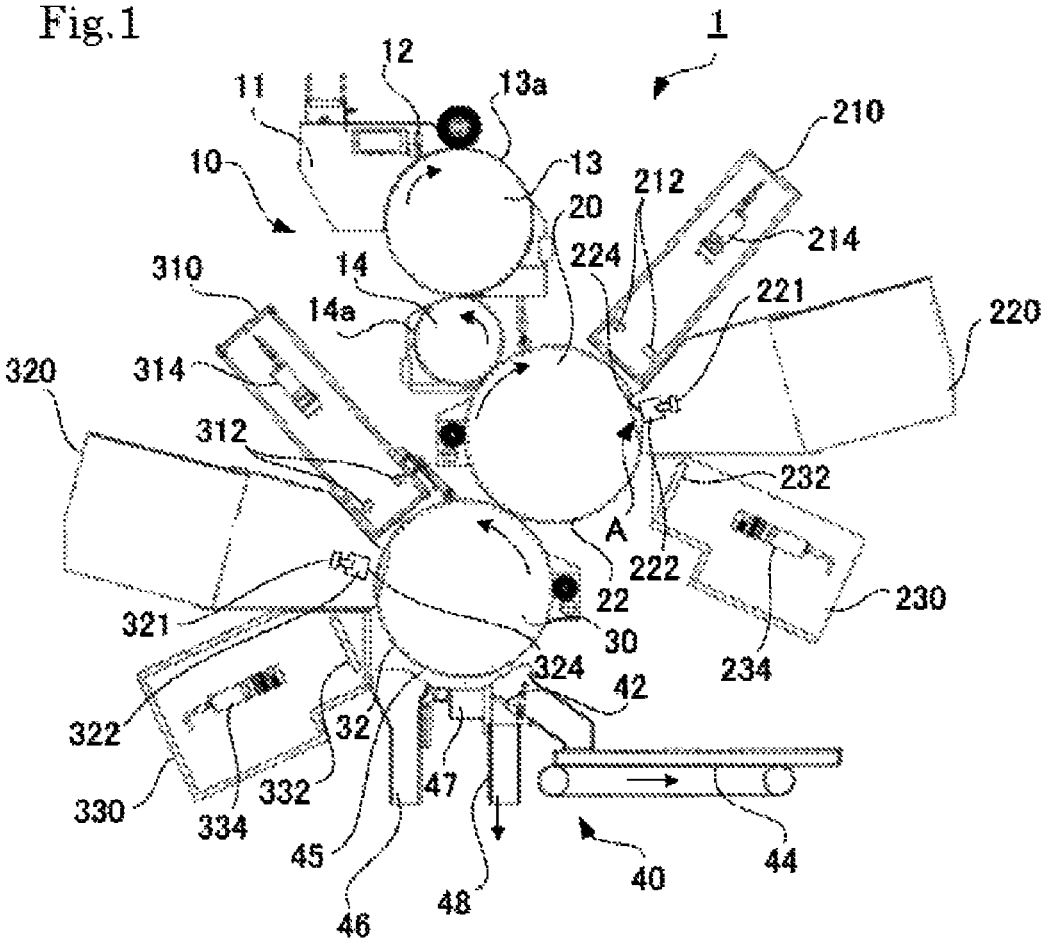
FIG. 1 is a schematic configurational diagram of an inkjet marking apparatus according to one embodiment of the present invention.

Below, an embodiment of the present invention will now be described with reference to the attached drawings. FIG. 1 is a schematic configurational diagram of an inkjet marking apparatus according to one embodiment of the present invention. As shown in FIG. 1, an inkjet marking apparatus 1 comprises a feeding device 10 for supplying printing substrates, a first carrier device 20 for receiving the printing substrates supplied from the feeding device 10 and conveying the printing substrates, a second carrier device 30 for receiving the printing substrates supplied from the first carrier device 20 and conveying the printing substrates, and an ejector 40 for receiving the printing substrates from the second carrier device 30 and ejecting the printing substrates to the outside.

The feeding device 10 comprises a hopper 11 to which printing substrates having a regular shape, such as tablets, capsules, or hollow capsules, are supplied, a feeder 12 for aligning the printing substrates in the hopper 11, and a feeding drum 13 for conveying the printing substrates guided by the feeder 12. The printing substrates are supplied from the feeding drum 13 to the first carrier device 20 via an intermediate drum 14. The feeding drum 13 and the intermediate drum 14 comprise a large number of holding parts 13*a* and 14*a* composed of recesses arranged in-line in the axial direction and the circumferential direction of the cylindrical outer circumferential surfaces, and are thus capable of suction-holding and conveying the printing substrates accommodated in the holding parts 13*a* and 14*a*.

Figure 2:
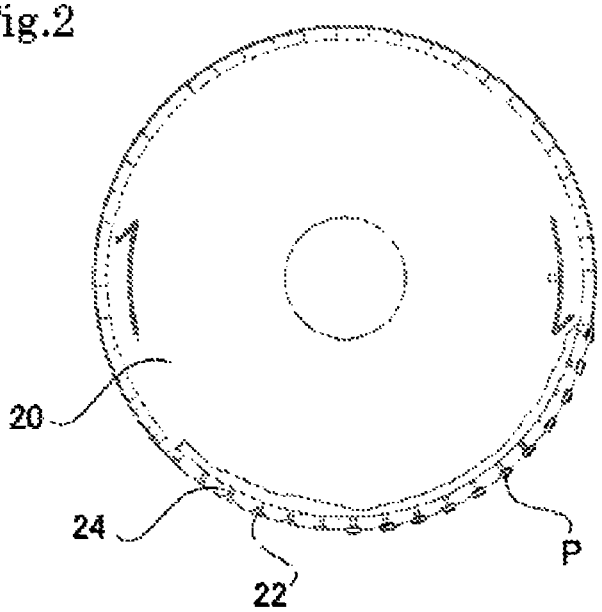
FIG. 2 is an enlarged diagram of principal parts of the inkjet marking apparatus.

The first carrier device 20 has a drum shape as with the feeding drum 13 and the intermediate drum 14, and as shown in the partially cutaway view of FIG. 2, a large number of holding parts 22 for holding printing substrates P are provided at equal intervals in both the circumferential direction of the outer circumferential surface and the direction of the rotational axis. The holding parts 22 are each provided with a vacuum hole 24 at the bottom, and by reducing the pressure inside the first carrier device 20 by a vacuum suction device (not shown), the holding parts 22 can suction-hold the printing substrates P accommodated in the holding parts 22 via the vacuum holes 24 and convey the printing substrates P in the rotational direction of the first carrier device 20 while preventing the orientation of the printing substrates P from changing during conveyance.

The second carrier device 30 has the same configuration as the first carrier device 20, and holding parts 32 are formed in the drum-shaped outer circumferential surface. The front and back of printing substrates conveyed by the first carrier device 20 are reversed when the printing substrates are transferred to the second carrier device 30, and the printing substrates are then conveyed to the ejector 40.

In the inkjet marking apparatus 1 having the above-described configuration, a first detecting device 210, a first printing device 220, and a first printing inspecting device 230 are provided near the first carrier device 20 in this order in the conveying direction of the first carrier device 20.

The first detecting device 210 comprises irradiating parts 212 for irradiating printing substrates conveyed to a detection area with illumination light, and an imaging part 214 such as a CCD area camera or a CCD line camera for capturing an image of the printing substrates from a direction different from the illumination directions of the light irradiating parts 212. The light irradiating parts 212 are, for example, ring illuminators and can uniformly irradiate the printing substrates from all sides. The first detecting device 210 detects whether the printing substrates P are held in the holding parts 22 of the first carrier device 20 and, when the printing substrates P are held, also detects the scores, recesses, outlines (contours), and the like of the printing substrates P to find the positions and the orientations of the printing substrates P.

The first printing device 220 comprises a printhead 222 movably supported by a guide rail 221 extending in the direction of the rotational shaft of the first carrier device 20. The printhead 222 comprises a large number (e.g., about several hundreds) of nozzles 224 on the surface facing the first carrier device 20, and performs inkjet printing on the printing substrates P conveyed to a printing area A by the first carrier device 20 to form a marking pattern on the surfaces of the printing substrates P. The direction in which the nozzles 224 are arranged is substantially the same as the direction in which the printhead 222 moves and is perpendicular to the direction in which the printing substrates P are conveyed in the present embodiment, but is not necessarily limited to the perpendicular direction as long as it intersects the direction in which the printing substrates P are conveyed.

Figure 3:
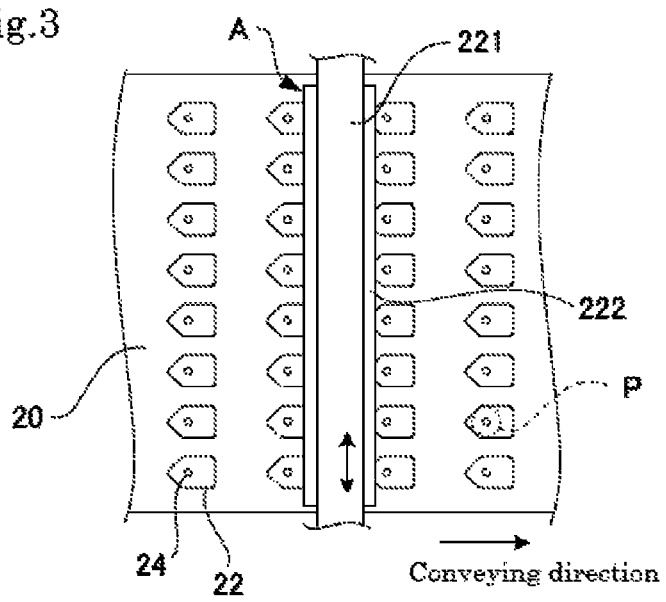
FIG. 3 is a development diagram showing other principal parts of the inkjet marking apparatus in a planar manner.

FIG. 3 is a development diagram showing a part of the outer circumferential surface of the first carrier device 20 in a planar manner. The holding parts 22 of the first carrier device 20 are each formed to be capable of accommodating the printing substrates P and provided to form rows in the direction perpendicular to the conveying direction, and the rows are provided at intervals in the conveying direction. The printhead 222 of the first printing device is provided to cover one entire row of the holding parts 22 conveyed to the printing area A, and is capable of reciprocating along the guide rail 221 as indicated by the arrow.

The first printing inspecting device 230 comprises an irradiating part 232 for irradiating printing substrates conveyed to an inspection area with illumination light, and an imaging part 234 such as a CCD area camera or a CCD line camera for capturing an image of the printing substrates, and inspects the marking pattern formed on the printing substrates based on the positions and the orientations of the printing substrates P detected by the first detecting device 210.

A second detecting device 310, a second printing device 320, and a second printing inspecting device 330 are provided near the second carrier device 30 in this order in the conveying direction of the second carrier device 30. The configurations of the second detecting device 310, the second printing device 320, and the second printing inspecting device 330 are identical to those of the first detecting device 210, the first printing device 220, and the first printing inspecting device 230, with the second detecting device 310 comprising irradiating parts 312 and an imaging part 314, and the second printing inspecting device 330 comprising an irradiating part 332 and an imaging part 334. The second carrier device 30 receives printing substrates from the first carrier device 20 and conveys the printing substrates, and the detection of the printing substrates P formation of a marking pattern, and marking inspection are sequentially performed by the second detecting device 310, the second printing device 320, and the second printing inspecting device 330 on the surface opposite to the surface on which a marking pattern was formed while being conveyed by the first carrier device 20.

The ejector 40 comprises a sorting part 42 for sorting printing substrates based on the results of marking inspection at the first printing inspecting device 230 and the second printing inspecting device 330, and guides only good products to an ejection conveyor 44 for ejection.

Figure 4:
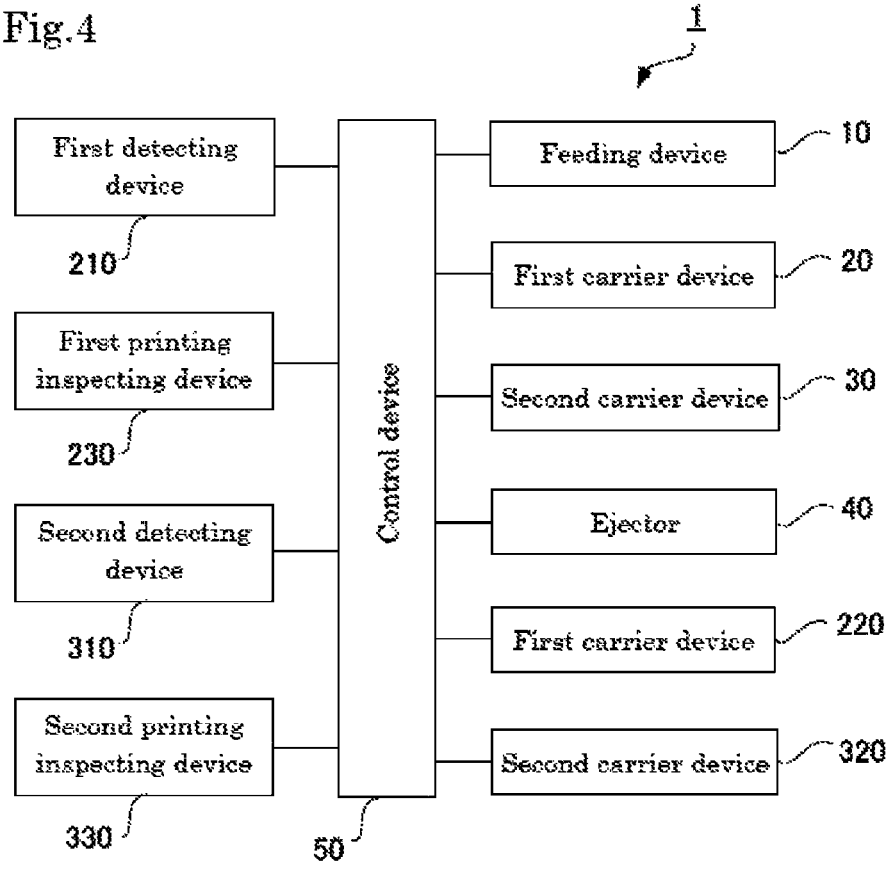
FIG. 4 is a block diagram showing the overall configuration of the inkjet marking apparatus.

FIG. 4 is a block diagram showing the overall configuration of the above-described inkjet marking apparatus 1. Results of detection by the first detecting device 210, the first printing inspecting device 230, the second detecting device 310, and the second printing inspecting device 330 are input into a control device 50. The control device 50 controls the operations of the feeding device 10, the first carrier device 20, the second carrier device 30, the ejector 40, the first printing device 220, and the second printing device 320.

Figure 5:
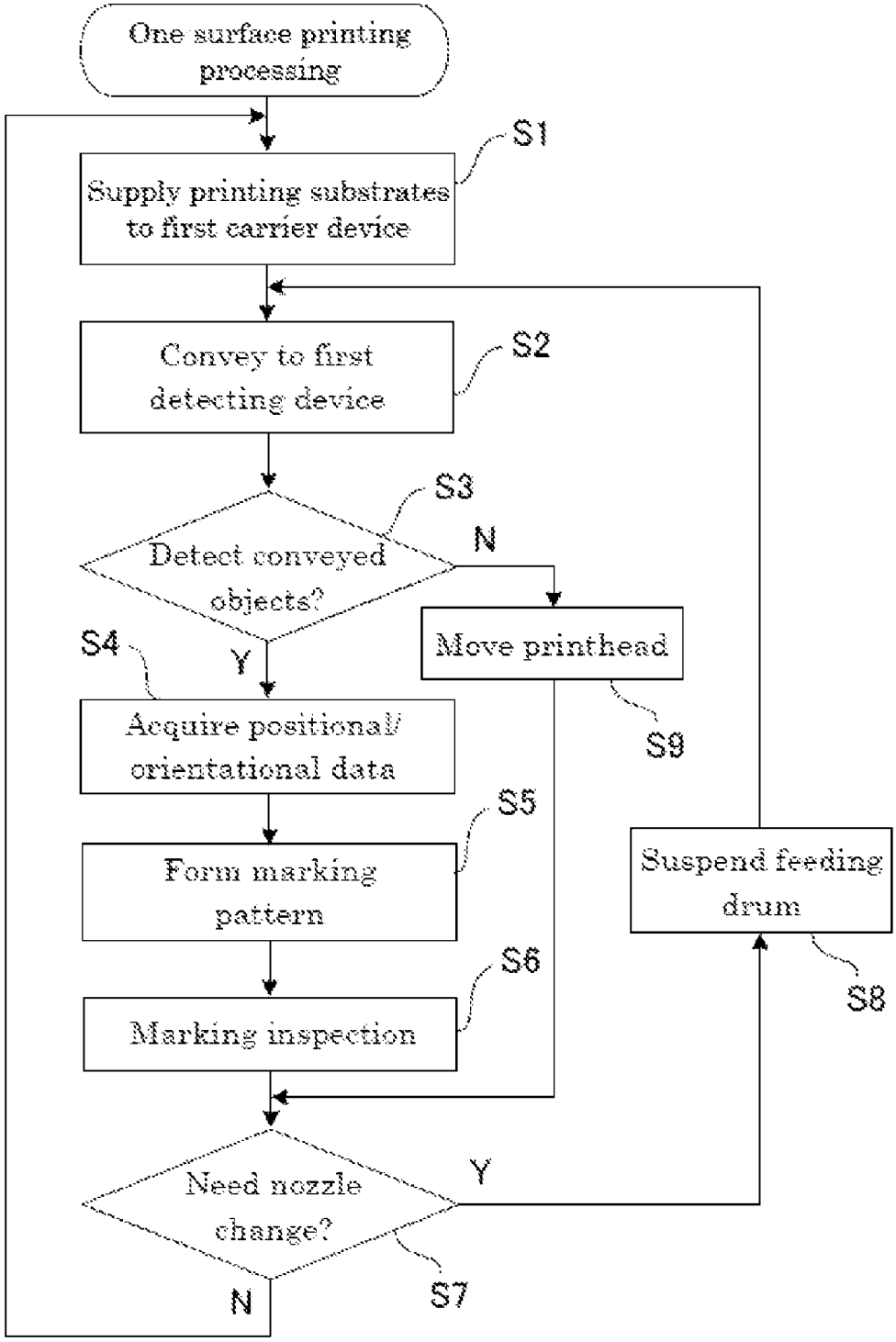
FIG. 5 is a flowchart showing one example of a method for marking printing substrates using the inkjet marking apparatus.
Figure 6:
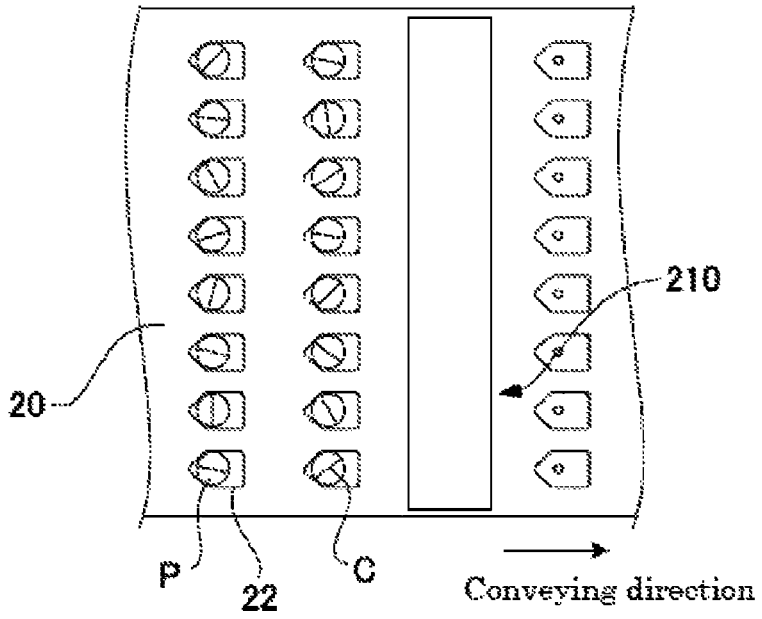
FIG. 6 shows diagrams for explaining the operation of the inkjet marking apparatus.
Figure 6:
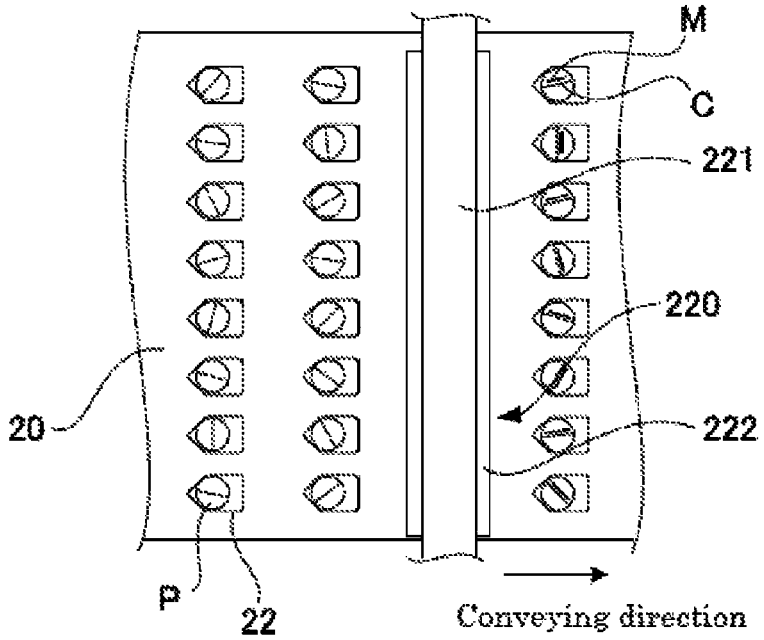

Next, one example of a method for marking printing substrates using the inkjet marking apparatus 1 having the above-described configuration will now be described in reference to the flowchart shown in FIG. 5. The printing substrates P, which are tablets, supplied to the first carrier device 20 from the feeding device 10 (step S1) are individually accommodated in the holding parts 22 so as to be aligned in the direction perpendicular to the conveying direction of the first carrier device 20 as shown in FIG. 6(*a*). When the printing substrates P have a score C, the orientation of the score C formed in each printing substrate P is random.

When the printing substrates P are conveyed to the detection area of the first detecting device 210 (step S2), the imaging part 214 detects whether the printing substrates P are held in the holding parts 22 (step S3). When the printing substrates P are present, the control device 50 acquires image data of the printing substrates P to detect the score C and thus acquire the positional data and the orientational data (X, Y θ) of each printing substrate P (step S4). For the printing substrates P, the acquired image data of which does not show the presence of the score C, this fact is output instead of orientational data.

Then, when the printing substrates P are conveyed to the printing area A of the first printing device 220, a marking pattern M is formed in accordance with the position and the orientation of each printing substrate P as shown in FIG. 6(*b*) (step S5). Coordinate data for a marking pattern composed of characters, numbers, symbols, figures, etc., or a combination thereof in a reference coordinate system is stored in the memory of the control device 50 in advance, and the nozzles 224 to be used of the printhead 222 are selected based on the positional data and the orientational data of each printing substrate input from the first detecting device 210 to perform inkjet printing.

Figure 7:
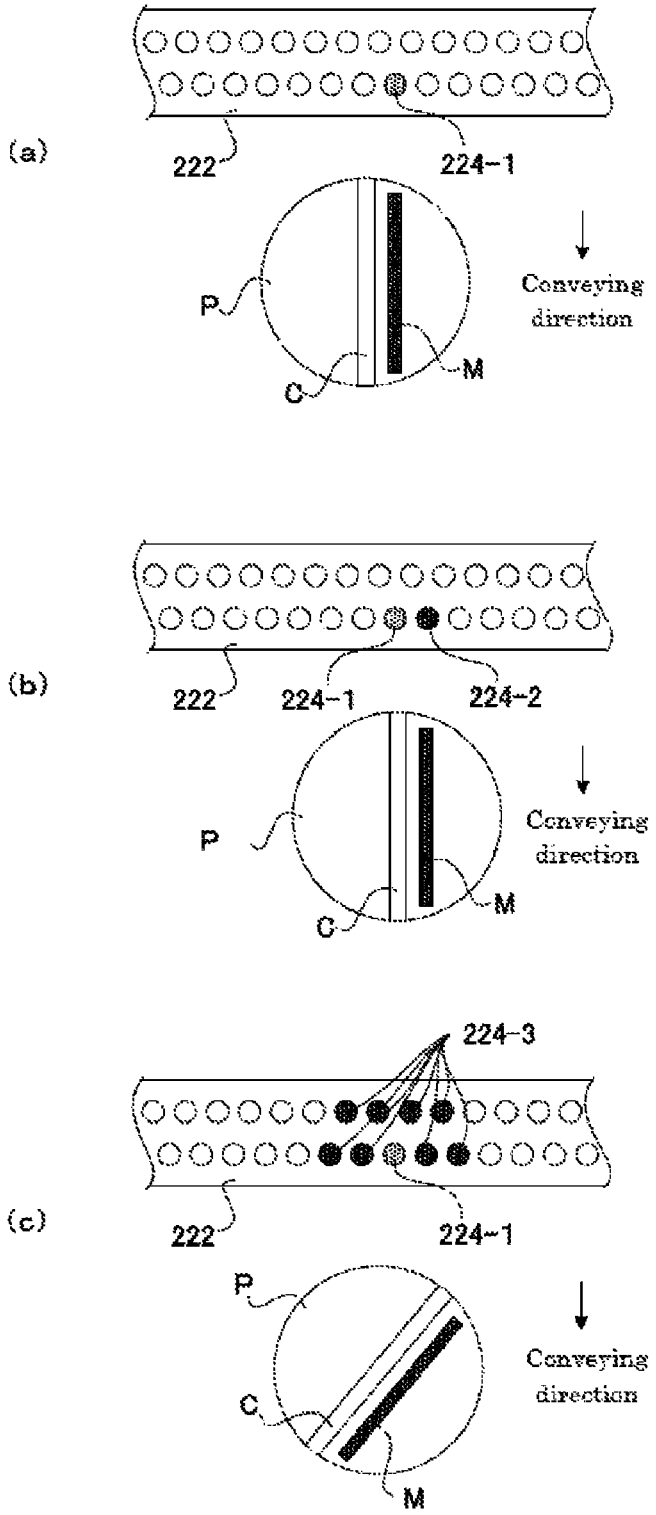
FIG. 7 shows diagrams for explaining the operation of the inkjet marking apparatus.

The nozzles 224 to be used and the injection time of each nozzle 224 vary depending on the positions and the orientations of the printing substrates P. For example, assuming that a linear marking pattern M is formed by a nozzle 224-1 when the position and the orientation of the printing substrate P match the reference position and the reference orientation as shown in FIG. 7(*a*), when the positional data (data concerning an X direction that is perpendicular to the conveying direction) of the printing substrate P acquired by the first detecting device 210 indicates a shift from the reference position, a nozzle 224-2 selected according to the amount of this shift is used for marking as shown in FIG. 7(*b*). When the orientational data (data concerning a θ direction originating from the reference position) of the printing substrate P acquired by the first detecting device 210 indicates a shift from the reference orientation, the number of nozzles to be used is increased according to the amount of this shift to involve nozzles 224-3 for marking as shown in FIG. 7(*c*).

When the printing substrates P are conveyed to the inspection area of the first printing inspecting device 230 after a marking pattern is formed on the printing substrates P, the imaging part 234 acquires image data of the printing substrates P for each row. The control device 50 compares this image data with pre-set reference pattern data to inspect marking accuracy by a known inspection method such as pattern matching (step S6).

In this way, the printing substrates P are continuously supplied from the feeding device 10 to the first carrier device 20 and then conveyed to the first printing device 220, and a marking pattern is sequentially formed on the printing substrates P. Repeatedly performing marking on the printing substrates P may result in a varied frequency between the nozzles 224 being used, and the nozzles 224 that are less frequently used may become clogged. Thus, the control device 50 determines whether nozzle change is necessary or not (step S7) and, in the case of nozzle change, suspends the rotation of the feeding drum 13 in the feeding device 10 (step S8). Accordingly, a non-holding area where the printing substrates P are not held is formed on the holding parts 14*a* of the intermediate drum 14, and a non-holding area where the printing substrates P are not held is formed on the holding parts 22 of the first carrier device 20 as well. It is also possible to directly supply the printing substrates P from the feeding drum 13 to the first carrier device 20 without involving the intermediate drum 14.

The method for determining the timing of nozzle change is not particularly limited. For example, the nozzle change timing can be determined according to whether the number of printing substrates printed by the first printing device 220 has reached a number statistically set in advance, or can be determined according to whether a predetermined varied frequency of use has been reached while monitoring the frequency of each nozzle 224 being used at all times.

Figure 8:
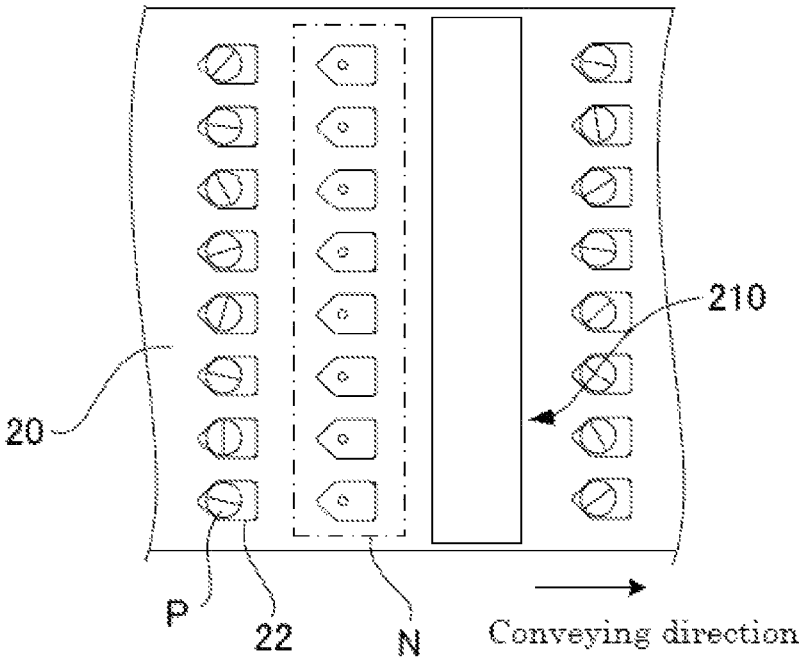
FIG. 8 is a diagram for explaining the operation of the inkjet marking apparatus.

As shown in FIG. 8, a non-holding area N formed on the first carrier device 20 is detected by the first detecting device 210. When the first carrier device 20 detects that no printing substrates P are held in the holding part 22 (step S3), the control device 50 moves the printhead 222 without performing marking during the time when the non-holding area N passes by the first printing device 220 (step S9). Accordingly, subsequent marking by the first printing device 220 can be performed with different nozzles 224. Although the non-holding area N formed on the first carrier device 20 is composed of only one row of the holding parts 22 in this embodiment, the non-holding area N can be also composed of multiple rows of the holding parts 22 in consideration of the time necessary for the printhead 222 to move.

Figure 9:
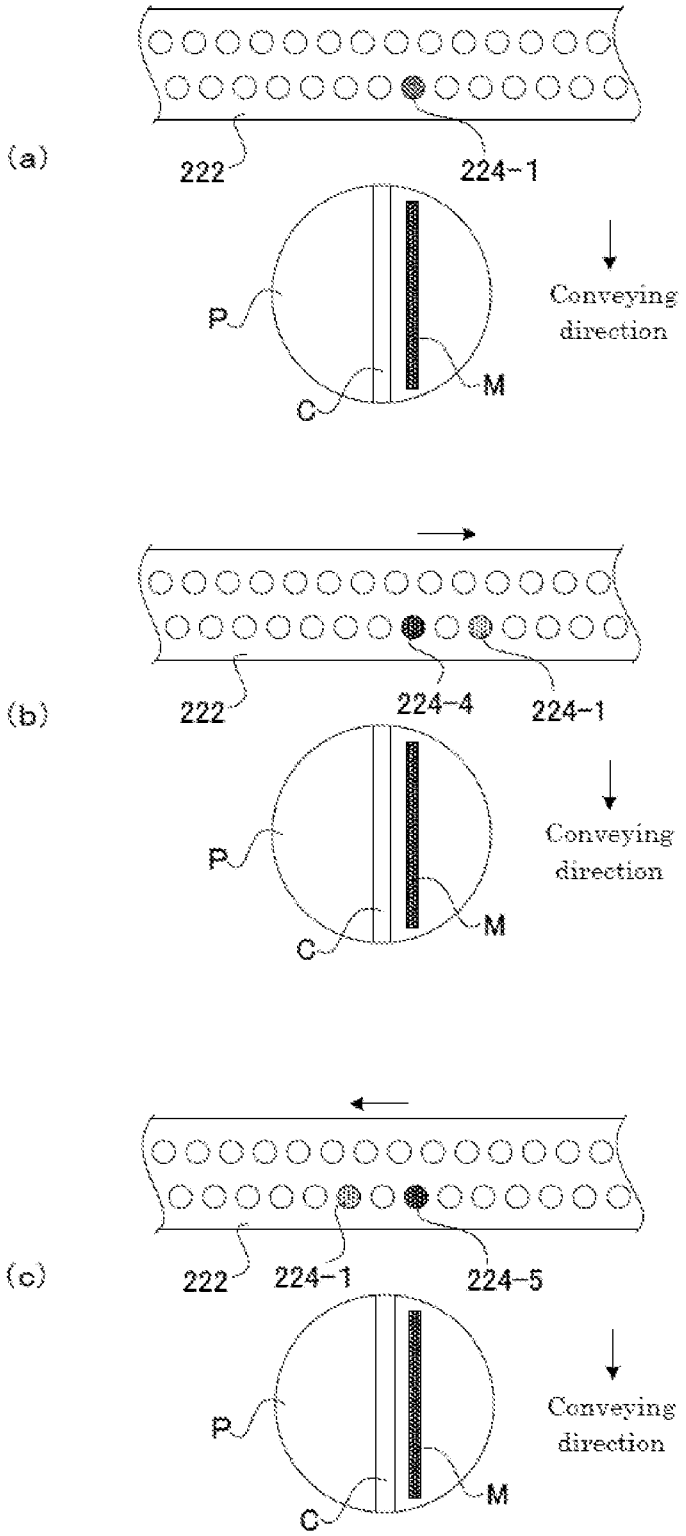
FIG. 9 shows diagrams for explaining the operation of the inkjet marking apparatus.

It is preferable that the direction and the amount of movement of the printhead 222 during nozzle change are set such that the nozzles 224 less frequently used for the printing substrate P located in the reference position and the reference orientation will be used most. For example, assuming that the linear marking pattern M is formed by the nozzle 224-1 when the position and the orientation of the printing substrate P match the reference position and the reference orientation as shown in FIG. 9(*a*), moving the printhead 222 rightward as shown in FIG. 9(*b*) changes the nozzle used for the printing substrate P located in the reference position and the reference orientation to another nozzle 224-4 located more leftward than the previously used nozzle 224-1 is. On the other hand, moving the printhead 222 leftward as shown in FIG. 9(*c*) changes the nozzle used for the printing substrate P located in the reference position and the reference orientation to another nozzle 224-5 located more rightward than the previously used nozzle 224-1 is. The nozzle 224 used for the reference position and the reference orientation can also be adjusted according to the amount of movement of the printhead 222, and moving the printhead 222 in view of the least frequently used nozzle 224 makes it possible to effectively change the nozzles.

After marking and inspection are performed on one surface of the printing substrates P in this way, the printing substrates P are transferred from the first carrier device 20 to the second carrier device 30 and sequentially conveyed to the second detecting device 310, the second printing device 320, and the second printing inspecting device 330, and marking and marking inspection are thus performed on the other surface of the printing substrates P in the same manner as above. That is to say, marking is performed on the printing substrates by the second printing device 320 based on the positional data and the orientational data acquired by the second detecting device 310, and marking accuracy is inspected by the second printing inspecting device 330 based on the detection data of the second detecting device 310. Printing processing on the other surface of the printing substrates P can also be performed through the same procedure as above according to the flowchart shown in FIG. 5, and nozzle change can be suitably performed by utilizing a non-holding area formed on the second carrier device 30.

Thereafter, the printing substrates P are conveyed from the second carrier device 30 to the ejector 40. Marking quality judgment data of each printing substrate P is input into the ejector 40 from the first printing inspecting device 230 and the second printing inspecting device 330, and printing substrates P judged to be good products are guided to an ejection conveyor 44 via the sorting part 42, while printing substrates P judged to be defective products are air-blown at a defective-product ejecting part 45 to be guided to a defective-product ejection chute 46. A defective-product ejection confirmation sensor 47 checks whether the printing substrates P judged to be defective products remain in the second carrier device 30, and defective printing substrates P if remaining, are guided by the sorting part 42 to a disposal chute 48.

The inkjet marking apparatus 1 of the present embodiment is configured such that, at the time of nozzle change when the nozzles used in the first printing inspecting device 230 and the second printing inspecting device 330 are changed, the operation of the feeding drum 13 of the feeding device 10 is suspended to form the non-holding area N where the printing substrates P are not held in the holding parts 22, 32 of the first carrier device 20 and the second carrier device 30, and, after the marking pattern M is formed on the printing substrates P the printheads 222, 322 are moved during the time when the non-holding area N passes through the printing area A, and it is therefore possible to secure the time for moving the printheads 222, 322 necessary for nozzle change while maintaining the high-speed conveying of the printing substrates P by the first carrier device 20 and the second carrier device 30. Accordingly, the nozzles 224, 324 are uniformly used, nozzle clogging can be effectively prevented, and marking can be promptly and reliably performed on a large amount of the printing substrates P.

Figure 10:
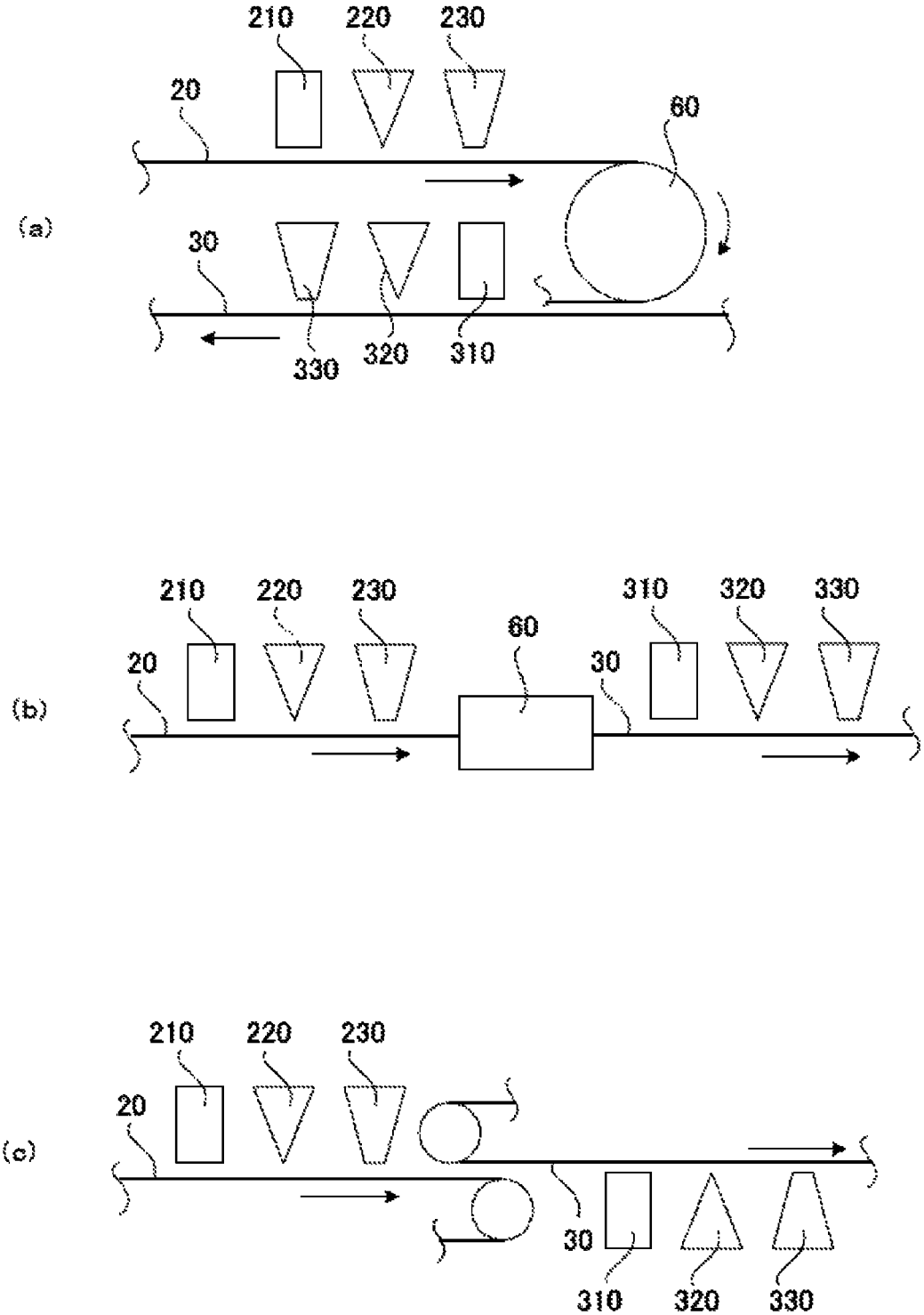
FIG. 10 shows schematic configurational diagrams of an inkjet marking apparatus according to another embodiment of the present invention.

One embodiment of the present invention has been described in detail above, but specific aspects of the present invention are not limited to the above embodiment. For example, while the first carrier device 20 and the second carrier device 30 are both carrier drums in the above embodiment, the carrier devices may be configured differently as long as the orientation of the held printing substrates does not change during conveyance. For example, as shown in FIGS. 10(*a*) and 10(*b*), the first carrier device 20 and the second carrier device 30 are both configured to be conveyor devices such as slat conveyors or belt conveyors, the front and the back of printing substrates horizontally conveyed by the first carrier device 20 are reversed by a reversal mechanism 60, then the printing substrates are placed on the second carrier device 30 to be horizontally conveyed, and thus marking can be performed on both front and back surfaces of the printing substrates as in the above embodiment. Moreover, as shown in FIG. 10(*c*), it is also possible to perform marking on both front and back surfaces of printing substrates by configuring the second carrier device 30 to be a suction belt having vacuum holes capable of vacuum-sucking the printing substrates from above, then suction-holding the printing substrates horizontally conveyed by the first carrier device 20 onto the second carrier device 30, and performing marking from below. In FIGS. 10(*a*) to 10(*c*), the same components as in FIG. 1 are given the same reference numbers. Also, the feeding device 10 may be configured into a conveyor form instead of including the feeding drum 13. A configuration may be adopted in which a marking is formed only on one surface of printing substrates, and a configuration may be adopted in which the second carrier device 30, the second detecting device 310, the second printing device 320, and the second printing inspecting device 330 are not provided.

REFERENCE SIGNS LIST

1 Inkjet marking apparatus
10 Feeding device
13 Feeding drum
20 First carrier device
210 First detecting device
220 First printing device
222 Printhead
224 Nozzle
230 First printing inspecting device
30 Second carrier device
310 Second detecting device
320 Second printing device

322 Printhead
324 Nozzle
330 Second printing inspecting device

The invention claimed is:

1. An inkjet marking apparatus comprising:

a carrier means having a plurality of holding parts for holding printing substrates, the holding parts being provided at intervals in a conveying direction;

a feeding means for supplying the printing substrates to the holding parts;

a printing means for forming a marking pattern by inkjet printing on the printing substrates conveyed to a printing area by the carrier means; and a control means for controlling operations of the carrier means, the feeding means, and the printing means, wherein the printing means comprises a printhead provided with a plurality of nozzles in a direction intersecting the conveying direction of the printing substrates, and the printhead is supported so as to be movable in the direction in which the nozzles are arranged, and the control means, at a time of nozzle change when the nozzles to be used are changed, suspends the operation of the feeding means to form a non-holding area on the carrier means where the printing substrates are not held in the holding parts and, after the printing substrates are printed, moves the printhead during a time when the non-holding area passes through the printing area.

2. The inkjet marking apparatus according to claim 1, wherein the carrier means has rows of the holding parts such that a plurality of printing substrates conveyed to the printing area are placed in a direction in which the nozzles are arranged, and the rows of the holding parts are provided at intervals in the conveying direction.

3. The inkjet marking apparatus according to claim 1, wherein the carrier means is formed in a drum shape having the holding parts in an outer circumferential surface.

4. The inkjet marking apparatus according to claim 1, wherein the feeding means comprises a feeding drum having a plurality of holding parts in an outer circumferential surface, and the holding parts are provided at intervals corresponding to the holding parts of the carrier means, and the control means suspends rotation of the feeding drum to form the non-holding area on the carrier means.

5. The inkjet marking apparatus according to claim 1, further comprising a detecting means for detecting the non-holding area before the holding parts pass through the printing area, wherein the control means moves the printhead based on detection of the non-holding area by the detecting means.

6. An inkjet marking method comprising:

a feeding step of supplying printing substrates to a plurality of holding parts of a carrier means, the holding parts being for holding the printing substrates and being provided at intervals in a conveying direction;

a conveying step of conveying the printing substrates held in the holding parts to a printing area of a printing means by an operation of the carrier means; and a printing step of forming a marking pattern on the printing substrates conveyed to the printing area by inkjet printing, wherein the printing means comprises a printhead provided with a plurality of nozzles in a direction intersecting the conveying direction of the printing substrates, and the printhead is supported so as to be movable in the direction in which the nozzles are arranged, in the feeding step, at a time of nozzle change when the nozzles used in the printing step are changed, a supply of the printing substrates to the holding parts is suspended to form a non-holding area on the carrier means where the printing substrates are not held in the holding parts, and in the printing step, after the printing substrates are printed, the printhead is moved during a time when the non-holding area passes through the printing area.

* * * * *